United States Patent [19]

Hook et al.

[11] Patent Number: 4,473,411

[45] Date of Patent: Sep. 25, 1984

[54] PROCESS OF MAKING ALUMINUM KILLED LOW MANGANESE DEEP DRAWING STEEL

[75] Inventors: Rollin E. Hook, Dayton; Ronald I. Kinnett, Hamilton, both of Ohio

[73] Assignee: Armco Inc., Middletown, Ohio

[21] Appl. No.: 515,202

[22] Filed: Jul. 20, 1983

[51] Int. Cl.[3] ..... C21D 8/04

[52] U.S. Cl. ..... 148/12 C; 148/12 D; 148/16

[58] Field of Search ..... 148/12 R, 12 C, 12 D, 148/12.1, 134, 16

[56] References Cited

U.S. PATENT DOCUMENTS

| | | | |
|---|---|---|---|
| 2,906,652 | 9/1959 | Kiefer, Jr. | 148/12 R |
| 3,513,036 | 5/1970 | McFarland et al. | 148/12 C |
| 3,843,415 | 10/1974 | Leslie | 148/12 D |

FOREIGN PATENT DOCUMENTS

| | | | |
|---|---|---|---|
| 53-97921 | 8/1978 | Japan | 148/12 R |
| 56-23231 | 3/1981 | Japan | 148/12 C |

*Primary Examiner*—Peter K. Skiff

*Attorney, Agent, or Firm*—Frost & Jacobs

[57] ABSTRACT

A process of making aluminum killed, low manganese, deep drawing steel having a manganese content of up to 0.24%. The steel is hot rolled to hot band, cold rolled to final gauge, annealed and subjected to a small amount of temper rolling. In the annealing step, the steel is box annealed in coil form in such a manner that a coil cold spot temperature of at least about 1100° F. (593° C.) and below about 1250° F. (677° C.) is achieved.

10 Claims, No Drawings

PROCESS OF MAKING ALUMINUM KILLED LOW MANGANESE DEEP DRAWING STEEL

TECHNICAL FIELD

The invention relates to an improved process for the manufacture of aluminum killed low manganese deep drawing steel, and more particularly to such a process which produces a product having an excellent average plastic strain ratio ($r_m$) which remains non-aging even when exposed to elevated temperatures of at least 550° F. (288° C.), the process also resulting in increased productivity and energy and cost savings.

BACKGROUND ART

For deep drawing applications, prior art workers have produced both rimming and aluminum killed steels having a conventional manganese content of about 0.27% to about 0.40%. Rimming steel is cheaper to manufacture and has cleaner surface properties in ingot form and as rolled. A small amount of temper rolling after annealing will eliminate as-annealed yield point elongation (YPE), but the steel will still age at ordinary room temperature (about 23° C.) in about 2 months resulting in the return of objectionable yield point elongation. Aluminum killed steel, on the other hand, will be permanently non-aging after a small amount of temper rolling following an anneal, so long as it is not exposed to elevated temperatures after the cold working. However, the non-aging quality of aluminum killed steel can be destroyed if the steel is subjected after temper rolling to a temperature as low as about 400° F. (205° C.).

As is well known in the art, the performance of sheet steel during deep drawing can be reasonably accurately predicted from the average plastic strain ratio, $r_m$. An average $r_m$ value is normally obtained from tensile tests on several specimens most usually taken at 0°, 45° and 90° to the rolling direction of the samples. The r value in each test direction is taken as the ratio of the width strain to the thickness strain. The average plastic strain ratio is then computed by the formula:

$$r_m = \frac{r_{0°} + r_{90°} + 2r_{45°}}{4}$$

Rimming steels with conventional manganese content from about 0.27% to about 0.40% demonstrate an $r_m$ of about 1.2. Aluminum killed steels having the same conventional manganese content usually demonstrate an $r_m$ of about 1.6. With both types of drawing quality steel, the hot reduced and cold rolled product is subjected to a box anneal. The box anneal for conventional killed steels is so conducted that the coldest temperature of the critical coil (usually the bottom coil in a single stack array) exceeds 1280° F. (693° C.). The prior art recognized that for conventional killed steels, $r_m$ is a function of temperature and soak time. An exemplary prior art anneal cycle for conventional killed steels has been about 1300° F. (704° C.) or more, with a soak time of 16 hours or more.

More recently, prior art workers have turned their attention to low manganese rimming and aluminum killed steels, having a manganese content of up to about 0.24%. With such low manganese rimming and aluminum killed steels, the steels have been subjected to substantially the same steps of hot rolling, cold rolling, annealing and temper rolling as were the conventional manganese rimming and aluminum killed steels. Prior art workers generally accepted that the cold spot in a box anneal should exceed about 1280° F. (693° C.). A typical standard practice box anneal cycle for low manganese, aluminum killed steel has been 1300° F. (704° C.) with a soak time of 16 hours, resulting in a cold spot of at least about 1280° F. (693° C.). Low manganese rimming steel has demonstrated $r_m$ values of about 1.5, while low manganese aluminum killed steel has demonstrated $r_m$ values of at least 1.7.

U.S. Pat. No. 3,668,016, for example, teaches a core-killed steel having a manganese content of from about 0.04 to about 0.02%. The reference speaks of box annealing at 1290° F. (700° C.) or 1310° F. (710° C.) with a soak time of from 4 to 5 hours. U.S. Pat. No. 3,709,744 teaches a vacuum degassed steel having a manganese content of 0.15%. This reference teaches an annealing temperature of from about 1200° F. (659° C.) to about 1350° F. (732° C.), followed by a soak of at least 12 hours. The preferred annealing practice according to this reference is a soak at about 1300° F. (704° C.) for a minimum of 12 hours and preferably for about 20 hours. U.S. Pat. No. 3,239,390 teaches a low manganese aluminum killed steel for enameling. The reference speaks of annealing at a temperature of 1290° F. (700° C.) with a soak of 5 hours. All of these references are exemplary of prior art low manganese steels subjected to conventional anneals.

In recent years manufactures have offered a deep drawing, aluminum killed, conventional manganese steel which is pre-painted and supplied in coil form by the manufacturer prior to fabrication by the customer. The coiled painted strip is cured by baking at a temperature of at least about 400° F. (214° C.) and usually at 490° F. (254° C.). Because of its aging characteristics rimming steel cannot be offered in a prepainted form. Even the aluminum killed, pre-painted, conventional manganese steel is subjected to a large number of rejects as the result of strain lines during subsequent forming. These strain lines are caused by aging during paint baking following temper rolling and are related to the presence of agglomerated carbides, nitrogen pick-up, or both.

The present invention is based upon the discovery that the $r_m$ value for low manganese, deep drawing, aluminum killed steel, unlike conventional manganese deep drawing aluminum killed steel, does not improve with annealing temperature and/or time. In fact, with the low manganese aluminum killed steel, virtually the maximum $r_m$ value is obtained immediately after complete recrystallization. As is known, lowering the manganese content also lowers the recrystallization temperature. Thus, the higher temperature and soak time of a conventional box anneal for a conventional manganese, deep drawing, aluminum killed steel, when applied to a low manganese, deep drawing, aluminum killed steel, does not improve the $r_m$ value, but rather promotes unwanted grain growth, nitrogen pick-up and agglomeration of the carbides. These results tend to promote aging and strains in the metal upon the forming thereof. Unwanted grain growth can produce orange peel strain (rough surface) upon forming, which may be objectionable.

It has further been discovered that excellent $r_m$ values can be achieved when a low manganese, deep drawing, aluminum killed steel is box annealed in such a way as to achieve a cold spot temperature of at least 1100° F.

(593° C.) and less than 1250° F. (677° C.). Ideally, the innermost and outermost convolutions of the coil should not exceed 1330° F. (721° C.). No soak time is required.

This box annealing treatment has a number of advantages. The lower temperature anneal produces excellent $r_m$ values and no serious abnormal grain growth problems occur which were previously found to be characteristic of low manganese, aluminum killed steel. Carbide agglomeration and nitrogen pick-up are are greatly reduced or eliminated. Productivity is increased by 30% or more (tons per hour) while achieving a savings in both energy and annealing gases used.

Furthermore, aluminum killed, low manganese steel, processed according to the present invention will not age when subjected to heat treatments up to about 550° F. (288° C.) and therefore is excellent for use in the manufacture of a pre-painted product.

DISCLOSURE OF THE INVENTION

According to the invention there is provided a process of producing an aluminum killed, low manganese, deep drawing steel. The steel, containing 0.24% maximum manganese is ingot poured and rolled into slabs or continuously cast into slabs. The resulting slabs are hot rolled in a conventional manner with a finishing temperature above $A_3$ and are then coiled at a temperature below about 1100° F. (593° C.) to prevent aluminum nitride from preciptating.

Thereafter, the steel is subjected to a cold reduction of at least about 60%. This is followed by a box anneal.

The box anneal is carried out in such a manner that a coil cold spot temperature of at least about 1100° F. (593° C.) and below about 1250° F. (677° C.) is achieved. Ideally, the innermost and outermost convolutions of the coil should not exceed about 1330° F. (721° C.). No soak time is required.

The steel is thereafter given a small amount of temper rolling in a conventional manner to eliminate the as-annealed yield point elongation. If desired, the temper rolled steel can be painted and baked at a temperature of from about 400° F. (204° C.) to about 550° F. (288° C.).

DETAILED DESCRIPTION OF THE INVENTION

The process of the present invention contemplates an aluminum killed, low manganese, deep drawing steel beginning with a typical melt composition which will yield a solid or strip composition in weight percent as follows:

Carbon: 0.10% maximum; ≦0.05% preferred
Manganese: 0.24% maximum; 0.18%–0.22% preferred
Sulfur: 0.018% maximum; ≦0.012% preferred
Aluminum (acid soluble): 0.10% maximum; 0.02%–0.05% preferred The balance comprising iron and those impurities incident to the mode of manufacture. The manganese content should be at least 10 times the sulfur content.

The melt is killed with aluminum. The steel is preferably continuously cast into slab form, as is known in the art, although it can be cast into ingots and rolled to slab form. Thereafter, the steel is conventionally rolled to hot band at a finishing temperature above the $A_3$ and coiled at a temperature less than about 1100° F. (593° C.) to prevent aluminum nitrides from precipitating, as is kown in the art. Thereafter, the steel is cold reduced at least 60%.

The cold reduced material is then subjected to a tight coil batch anneal. Contrary to the prior art practice, the batch annealing furnace is fired at a rate such that a coil cold spot temperature is achieved of at least 1100° F. (593° C.) and less than 1250° F. (677° C.). A cold spot temperature of about 1200° F. (649° C.) is preferred. Ideally, the innermost and outermost coil convolutions should achieve a temperature not exceeding 1330° F. (721° C.) and preferably 1300° F. (704° C.).

The box annealing step of the present invention can be an open coil annealing. In this instance, the box annealing furnace should be fired in such a manner that aluminum nitrides precipitate prior to recrystalization and the coil convolutions ultimately achieve a temperature of at least 1100° F. (593° C.) and less than 1250° F. (677° C.). Preferably, the coils should achieve a temperature of about 1200° F. (649° C.).

Following the anealing step, the steel should be subjected to temper rolling to eliminate yield point elongation, as is known in the art. This temper rolling can be accomplished as a skin pass through a temper mill producing an elongation of at least about 0.5%.

It has been found that the process of the present invention will produce a low manganese, deep drawing, aluminum killed steel having $r_m$ values which average about 1.8.

As indicated above, the present invention is based upon the discovery that the $r_m$ value for low manganese, deep drawing, aluminum killed steel, unlike the $r_m$ value for conventional manganese, deep drawing, aluminum killed steel, does not improve with annealing temperature and/or time. Rather, with low manganese, aluminum killed steel, the maximum $r_m$ value is obtained immediately upon recrystallization. Since the lowering of the manganese content also lowers the recrystallization temperature, the above described box anneal procedures can be followed, with lower temperatures and no soak time. The process of the present invention results in a number of advantages, next to be discussed.

It has been found that the annealing step of the present invention results in marked savings in time, energy and annealing atmosphere. This, in turn, results in an increase in productivity of about 30% or more (tons per hour).

In the production of low manganese, deep drawing, aluminum killed steels, by conventional high temperature box annealing normally applied to conventional manganese, aluminum killed steel, occasional grain structure abnormalities in the form of large, highly elongated grains have been encountered. To compound this difficulty, these abnormalities did not occur with a high degree of frequency, or to the same degree of severity. However, when these large, highly elongated, grains did occur, they frequently resulted in "orange peel" strain following a deep drawing operation.

It has been found that the carbide morphology in low manganese steel, combined with the high annealing temperatures practiced by prior art workers, can result in abnormal grain growth. Low manganese steel, as hot rolled, has a larger amount of grain boundary carbides than does conventional manganese steel. Cold rolling causes the grain boundary carbides to be broken up and aligned in the plane of the sheet. Since the tendency for abnormal grain growth (i.e., secondary recrystallization) is known to increase as the interparticle spacing decreases, as a result of the inhibiting of normal grain growth by a particle dispersion, there is therefore a greater tendency for abnormal grain growth in the low manganese steel. The anisotropic arrangement of carbide particles provides paths for grain boundary movements parallel to the rolling direction, where the interparticle spacing is much larger than in the thickness direction, where the particle dispersion is layered parallel to the rolling plane. This accounts for the tendency for abnormally large, elongated grains to form in low manganese steel. It has been discovered that in the practice of the present invention the low annealing temperatures and lack of soak time minimizes or eliminates such abnormal grain growth. In the rating of grain size, the larger the number, the smaller the grains. Grain sizes ranging from 7 to 9 are acceptable, while grain sizes below 7 can result in "orange peel" strain. In the practice of the present invention, grain sizes in the range of 7 to 9 are achieved.

As is known in the art, yield point elongation occurring after a steel has been annealed and temper rolled so as to reduce its as-annealed yield point elongation to 0%, is a measure of a steel's propensity to age. If the yield point elongation has a value of 0%, after the steel has experienced some time-temperature history following temper rolling, the material has not strain aged. If the value is much above 0%, strain aging has occurred.

Strain aging is normally brought about by the presence of carbon and/or nitrogen in interstitial solid solution. In prior art practice, with an annealing step at higher temperatures and prolonged times, nitrogen was picked up by the steel from the annealing atmosphere. If, due to nitrogen picked up in annealing, the total nitrogen content of the steel after annealing exceeds about one half the aluminum content, nitrogen can exist in interstitial solid solution. That is, not all of the nitrogen will be combined as aluminum nitride. It has been found that in the practice of the present invention, nitrogen pick-up during the box anneal is negligible.

The presence of agglomerated carbides increases the tendency of the steel to strain age due to carbon being retained in solid solution following cooling from annealing. The short time-low temperature anneal of the present invention results in small, scattered carbide particles and substantially eliminates the chance for agglomeration of the carbides.

As indicated above, both conventional and low manganese, deep drawing, aluminum killed steels, if temper rolled after the annealing step, are non-aging at a normal room temperature (23° C.). But if they are subjected to an elevated temperature following the temper rolling, they may age. Sometimes, for example, the steels can age (show YPE return) as a result of a heat treatment at a temperature as low as 400° F. (204° C.).

In recent years, steel manufacturers have offered deep drawing, aluminum killed steels which have been prepainted. An exemplary, but nonlimiting chrome complex primer material is that sold by Diamond Shamrock of Cleveland, Ohio, under the mark "Dacromet". This material is a primer or undercoat, requiring baking at a temperature of about 490° F. (254° C.). This primer is usually coated with a zinc rich paint, such as, for example, that sold by Wyandotte Chemical Corporation of Wyandotte, Mich., under the mark "Zincromet". Prepainted and baked conventional manganese, deep drawing, aluminum killed steels, subjected to the above described prior art box anneal step, frequently demonstrated strain aging after paint baking, because of the presence of free nitrogen due to pick up in annealing or free carbon in solution related to the formation of agglomerated carbides in annealing. This strain aging results in return of yield point elongation which results in objectionable strain lines, surface appearance blemishes, on formed parts.

It has been discovered that low manganese, deep drawing, aluminum killed steels processed and annealed in accordance with the present invention can, following the temper rolling step, be prepainted and baked without demonstrating strain aging. In fact, the low manganese, deep drawing, aluminum killed steels of the present invention are capable of withstanding baking temperatures up to about 550° F. (288° C.) without demonstrating strain aging. It is believed that this is due to the fact that nitrogen pick-up during the anneal in accordance with the present invention is negligible and course or agglomerated carbides are not present in the steel.

EXAMPLE I

Slabs of low manganese, aluminum killed steel were hot rolled to hot band 0.095 inch, (2.41 mm) using a 1050° F. (566° C.) aim coiling temperature. The hot band coils were cold reduced 66.5% to 0.0318 inch (0.808 mm) gauge.

Eight cold rolled coils were annealed in three box annealing furnaces. Each coil contained a wound-in thermocouple to monitor cold spot temperatures. All of the coils were 52.6 inches wide. The annealing parameters were listed in Table I below.

TABLE I

| Coil # | Coil Pos'n | Coil wt.-lbs. | Cold Spot Temp. End of Firing | Max. Top Edge Temp. | Max. Cold Spot Temp. |
|---|---|---|---|---|---|
| Furnace 1, 1300° F. Gas Steam | | | | | |
| 1 | B | 57,990 | 123F-38 Hr.* | | 1248F-40 Hr.** |
| 2 | M | 57,610 | 1245F | | 1258F |
| 3 | T | 45,120 | 1289F | 1394F | 1289F |
| Furnace 2, 1280° F. Gas Stream | | | | | |
| 4 | B | 42,640 | 1169F-27 Hr.* | | 1188F-28 Hr.** |
| 5 | T | 24,800 | 1293F | 1336F | 1298F |
| Furnace 3, 1280° F. Gas Stream | | | | | |
| 6 | B | 60,720 | 1185F-32 Hr.* | | 1190F-34 Hr.** |
| 7 | M | 55,340 | 1185F | | 1190F |
| 8 | T | 43,390 | 1215F | 1310F | 1218F |

*actual firing time.
**time to reach actual cold spot temperature.

The firing time to reach an 1150° F. (621° C.) cold spot temperature was calculated for each furnace. It will be noted that furnaces 1 and 2 were fired for 6 hours beyond the calculated firing time.

After annealing, the coils were tempered rolled 1% and were then sent to a corrective rewind line to secure front, middle and tail samples for evaluation. Coils 1, 2 and 3 from furnace 1 were also sampled at the temper mill before tempering. These last mentioned samples were cut from the first 6 outside laps before tempering to evaluate effects of outside lap overheating on the properties and microstructure.

The coils were then sent to a coil paint line for application of "Dacromet" and "Zincromet".

The sheet compositions are listed in Table II below:

TABLE II

| Sheet Compositions, Mid-width Location, Sampled After Temper at Corrective Rewinder. | | | | | | | | |
|---|---|---|---|---|---|---|---|---|
| Coil Sample | Furnace | Coil Pso'n | Lap Loc'n In Annealing | C | S | N | Mn | Al |
| 1F | 1 | B | Inside | | | .0061 | | |
| 1M | | | Middle | .040 | .0094 | .011 | .21 | .070 |
| 1T | | | *Outside | | | .017 | | |
| 2F | | M | Inside | | | .0066 | | |
| 2M | | | Middle | .037 | .0094 | .0071 | .21 | .068 |
| 2T | | | *Outside | | | .012 | | |
| 3F | | T | Inside | | .0090 | | | |
| 3M | | | Middle | .035 | .0097 | .0091 | .21 | .071 |
| 3T | | | *Outside | | | .017 | | |
| 4F | 2 | B | Inside | | | .0066 | | |
| 4M | | | Middle | .040 | .011 | .0066 | .21 | .058 |
| 4T | | | Outside | | | .0066 | | |
| 5F | | T | Inside | .036 | .0091 | .0066 | .21 | .071 |
| 5T | | | Outside | | | .0092 | | |
| 6 | 3 | B | No Samples | | | | | |
| 7F | | M | Inside | .041 | .011 | .0061 | .20 | .056 |
| 7M | | | Middle | .048 | .010 | .0060 | .20 | .055 |
| 7T | | | Outside | .045 | .012 | .0065 | .20 | .051 |
| 8F | | T | Inside | .039 | .011 | .0056 | .21 | .061 |
| 8M | | | Middle | .040 | .011 | .0060 | .21 | .059 |
| 8T | | | Outside | .043 | .012 | .0061 | .21 | .059 |

*6 outside laps cut off coils after annealing, but ahead of the temper mill.

It will be noted from Table II that nitrogen pick-up was very low except for coil samples 1T, 2T and 3T. It will be noted that these last mentioned three samples are near outside lap samples, six outside convolutions having been removed ahead of tempered rolling. These three coils attained the highest cold spot temperatures (see Table I). The outside convolutions were therefore over annealed to a greater degree than those of the other coils and nitrogen pick-up was therefore greater.

The $r_m$ values for the samples of 7 of the 8 coils are listed in Table III below. These samples were obtained at the corrective rewind line after temper rolling, but before coil paint line coating. The $r_m$ values would not change as a result of the coil painting operation.

TABLE III

| Coil Sample # | Furnace | Coil Pos'n | Lap. Loc'n In Annealing | $r_m$ |
|---|---|---|---|---|
| 1F | 1 | B | Inside | 1.73 |
| 1M | | | Middle | 1.78 |
| 1T | | | *Outside | 1.77 |
| 2F | | M | Inside | 1.79 |
| 2M | | | Middle | 1.75 |
| 2T | | | *Outside | 1.79 |
| 3F | | T | Inside | 1.79 |
| 3M | | | Middle | 1.77 |
| 3T | | | *Outside | 1.82 |
| 4F | 2 | B | Inside | 1.85 |
| 4M | | | Middle | 1.77 |
| 4T | | | Outside | 1.81 |
| 5F | | T | Inside | 1.73 |
| 5T | | | Outside | 1.73 |
| 6 (No Samples) | 3 | B | | |
| 7F | | M | Inside | 1.65 |
| 7M | | | Middle | 1.79 |
| 7T | | | Outside | 1.82 |
| 8F | | T | Inside | 1.77 |
| 8M | | | Middle | 1.78 |
| 8T | | | Outside | 1.78 |

*6 outside laps previously removed ahead of temper mill.

Table IV lists the ASTM grain size and carbide ratings for the samples. Again, this was done at the corrective rewind line after temper rolling, but before coil paint line coating.

Carbide size rating was done on the basis of C-1 to C-5, where carbides rated C-1 or C-2 are small, scattered and acceptable. Carbides rated C-3 through C-5, on the other hand, are agglomerated, the size increasing from C-3 to C-5.

It will be noted that the carbides were small (C-1 to C-3) except for the near outside laps on coils 1 and 3. Apparently some overheating of these laps occurred. Maintaining the carbides small is desirable to avoid potention carbon aging during the paint baking operation.

TABLE IV

| Coil Sample | Furnace | Coil Pos'n | Lap Loc'n In Annealing | Carbides | ASTM G.S. NO. |
|---|---|---|---|---|---|
| 1F | 1 | B | Inside | C-1, some C-2 | 9 w/s 8** |
| 1M | | | Middle | C-1 heavy, some C-2 | 8–9 |
| 1T | | | *Outside | C-4, C-5 | 6–7 |
| 2F | | M | Inside | C-1 heavy, some C-2 | 9 w/s 8 |
| 2M | | | Middle | C-1 heavy, some C-2 | 9 w/s 8 |
| 2T | | | *Outside | C-2, C-3 | 7 |
| 3F | | T | Inside | C-1 heavy, some C-2 | 8 w/s 9 |
| 3B | | | Middle | C-1, some C-2 | 8 w/s 9 |
| 3T | | | *Outside | C-4, C-5 | 6–7 |
| 4F | 2 | B | Inside | C-1 heavy | 9 w/s 8 |
| 4M | | | Middle | C-1 heavy | 9 w/s 8 |
| 4T | | | Outside | C-1 heavy | 8–9 |
| 5F | | T | Inside | C-1, some C-2 | 8 w/s 9 |
| 5T | | | Outside | C-1, some C-2 | 8 w/s 9 |
| 6 | 3 | B | | | |
| 7F | | M | Inside | C-1 | 8 w/s 7 |
| 7M | | | Middle | C-1 | 7–8 |
| 7T | | | Outside | C-2, some C-1 | 8 one surf. 5–6, other surface |
| 8F | | T | Inside | C-1 | 8 |
| 8M | | | Middle | C-1 | 7–8 |
| 8T | | | Outside | C-1, some C-2 | 7.5 |

*6 outside laps cut off coils ahead of temper mill.
**w/s = "with some".

The coils of this Example were treated on the coil paint line, being coated with "Dacromet" and "Zincrometal" and baked at a temperature of about 490° F. (254° C.), for a period of about 30 seconds. Front and tail samples were tested for percent yield point elongation and all of the samples demonstrated a percent yield point elongation of 0%, except for three samples which demonstrated a percent yield point elongation of 0.5, 0.2 and 0.5. This small amount of YPE is sufficient to give rise to objectionable strain lines on formed parts. All of these last mentioned samples were taken from those coils 1, 2 and 3 treated in Furnace No. 1 and demonstrate that the outside coil convolution temperature during the anneal should be kept below about 1330° F. (721° C.) and preferably below 1300° F. (704° C.). These three samples, showing YPE corresponding to near outside lap locations in annealing, demonstrated carbides of C-4, C-5; C-2, C-3; and C-4, C-5, respectively. They also demonstrated % nitrogen of 0.017, 0.012 and 0.017, respectively. The outside convolutions of these coils were overheated.

It will be noted from the example that the present invention teaches a lower cost processing for aluminum killed, low manganese, box annealed steel. This nonaging steel will remain free of strain even if heated at paint baking temperatures.

EXAMPLE II 123 mid-width samples of aluminum killed, low manganese (about 0.20%) steel were taken from near outside, middle and near inside laps of 111 coils produced from 26 ingot teemed heats. The majority of this material was coiled on the hot strip mill at an aim coiling temperature of 1050° F. (566° C.) except for a small portion of the material which was coiled at an aim coiling temperature of 1025° F. (522° C.). The material was cold reduced within the range of from about 65% to about 69%.

The majority of the coils were box annealed in direct fired furnaces, while eight of the coils were annealed in radiant tube fired furnaces. Most of the boxes were built three coils high, while a few were built two coils high. The firing cycle was such as to produce a cold spot aim temperature of 1180° F. (638° C.). It was found that this annealing cycle resulted in a productivity gain (tons/hour) of about 30% over the above noted typical prior art annealing cycle for such material. The annealing step was conducted without a soak.

Following annealing, the coils were temper rolled. While a few samples were obtained at the temper mill, the majority of the samples were collected at the corrective rewind line following temper rolling.

The mean $r_m$ value as determined from the 123 samples was 1.79. Of the near outside lap samples, seven out of 34 demonstrated $r_m$ values of less than 1.70 and two out of 34 demonstrated $r_m$ values of less than 1.60. Of the middle lap samples, 15 out of 57 demonstrated a $r_m$ value of less than 1.70, while five out of 57 demonstrated a $r_m$ value of less than 1.60. Finally, of the near inside lap samples, five out of 32 demonstrated a $r_m$ value of less than 1.70 and one of 32 demonstrated a $r_m$ value of less than 1.60. The spread in $r_m$ values from the mean to the low end of the range could not be identified with composition or annealing variations. It is believed that the spread is attributable to coiling temperature variations.

The annealing cycle resulted in the virtual elimination of nitrogen pick-up during the annealing step. While some nitrogen pick-up did occur, it was confined to the overheated outside and near outside coil laps. Most of this affected material (87% in this instance) was removed by ordinary coil end scrap losses at the temper mill. Elimination of nitrogen pick-up eliminates nitrogen strain aging as a factor in the development of yield point elongation after a paint baking step.

The annealing cycle further resulted in avoiding the formation of large agglomerated carbides, except for overheated outside and near outside coil laps. Again, most of the affected material (in this instance, 80%) was removed by ordinary coil end scrap losses at the temper mill. Elimination of the formation of agglomerated carbides eliminates carbon strain aging as a factor in the development of yield point elongation after paint baking.

The annealing cycle used virtually eliminated abnormal grain growth except in the overheated coil outside or near outside laps. Again, most of the affected material (87% in this case) was eliminated by ordinary coil end scrap losses at the temper mill.

Modifications may be made in the invention without departing from the spirit of it.

What is claimed is:

1. A process of making aluminum killed, deep drawing, low manganese steel having a $r_m$ value of at least 1.7, including the steps of providing a steel having a manganese content of from about 0.12% to about 0.24%, conventionally hot rolling said steel to hot band with a finishing temperature above $A_3$, conventionally coiling said steel at a temperature below about 1100° F. (593° C.), cold rolling said steel to final gauge, box annealing said steel so as to achieve a coil temperature between about 1100° F. (593° C.) and about 1250° F. (677° C.), terminating said anneal upon achievement of said coil temperature, and temper rolling said steel.

2. The process claimed in claim 1 wherein said anneal is a tight-coil box anneal and including the step of conducting said anneal only until a coil cold spot temperature between about 1100° F. (593° C.) and about 1250° F. (677° C.) is achieved.

3. The process claimed in claim 1 wherein said box anneal is an open-coil anneal.

4. The process claimed in claim 1 wherein said low manganese steel has a solid composition in weight percent in addition to said manganese of about 0.1% maximum carbon, about 0.018% maximum sulfur and about 0.1% maximum aluminum, the balance comprising iron and those impurities incident to the mode of manufacture.

5. The process claimed in claim 1 wherein said coil temperature is about 1200° F. (649° C.).

6. The process claimed in claim 2 wherein said cold spot temperature is about 1200° F. (649° C.).

7. The process claimed in claim 3 wherein said coil temperature is about 1200° F. (649° C.).

8. The process claimed in claim 1 including the step of painting said temper rolled low manganese steel and baking said steel at a temperature of at least 400° F. (214° C.).

9. The process claimed in claim 2 including the step of painting said temper rolled low manganese steel and baking said steel at a temperature of at least 400° F. (214° C.).

10. The process claimed in claim 1 wherein said anneal is so conducted that the innermost and outermost coil convolutions achieve a temperature not exceeding about 1330° F. (721° C.).

* * * * *